United States Patent [19]

Kirk, Jr. et al.

[11] 3,960,425

[45] June 1, 1976

[54] HARNESS CABLE CONNECTOR

[75] Inventors: Donald C. Kirk, Jr., Naugatuck; Otto Morin, Newtown, both of Conn.

[73] Assignee: Litton Systems, Inc., Beverly Hills, Calif.

[22] Filed: Feb. 25, 1975

[21] Appl. No.: 552,753

[52] U.S. Cl. ..... 339/17 R; 339/103 M; 174/72 A

[51] Int. Cl.[2] ..... H01R 13/58

[58] Field of Search ..... 339/17 R, 17 C, 17 CF, 339/17 F, 17 L, 17 LC, 103 R, 103 M, 176 MF, 176 MP; 174/72 A, 135; 317/122

[56] References Cited

UNITED STATES PATENTS

| | | | |
|---|---|---|---|
| 2,946,033 | 7/1960 | Wirth | 339/176 MP X |
| 3,573,719 | 4/1971 | Lightner | 339/17 L X |
| 3,688,635 | 9/1972 | Fegen | 339/128 X |
| 3,744,009 | 7/1973 | Teagno et al. | 339/176 MP X |
| 3,774,080 | 11/1973 | Weidel | 339/17 LC X |

*Primary Examiner*—Joseph H. McGlynn
*Assistant Examiner*—Craig R. Feinberg
*Attorney, Agent, or Firm*—M. Michael Carpenter; Alan C. Rose; Alfred B. Levine

[57] ABSTRACT

A harness cable connector is shown which receives a plurality of insulated wires by a press fit for retaining the wires in a spaced configuration during insertion and assembly of the wires in a printed circuit board. The cable connector is then rolled and locked into the printed circuit board to provide strain relief for the harness cable.

11 Claims, 4 Drawing Figures

HARNESS CABLE CONNECTOR

BACKGROUND OF THE INVENTION

The present invention relates to a harness cable connector and, more particularly, to a connector which receives and retains a plurality of wires for insertion and assembly into a printed circuit board and provides strain relief for the wires after assembly.

It is known in the prior art to construct cables from multiple strands of wire which may be bound together by cord or cable ties. It is also known to provide a plurality of insulated wires in a flat cable/round wire configuration wherein the wires are joined together by a woven harness or the wire insulation is molded into a flat cable. Flat cables have also been constructed by sandwiching conductive strips between layers of insulation to form a flexible ribbon-like cable.

The art is replete with electrical connectors for terminating the various cable configurations mentioned herein. For example, a bundle of bound or tied insulated wires may be terminated with individual terminals which are crimped to the end of each conductive wire and then connected to a terminal board by a plurality of screw terminals for receiving the individual terminals attached to each wire. With the flat cable/round wire configuration, it is known to provide insulation piercing connectors with conductive elements which pierce each round wire within the cable. The flexible ribbon-like cable has also been terminated by connectors which pierce the insulation layer to provide electrical connection between the flat cable and a suitable utilization device to which the connector is joined, such as a printed circuit board.

SUMMARY OF THE INVENTION

The present invention provides a low-cost means for terminating a flat cable/round wire configuration that eliminates many of the more expensive features of the prior art by providing a low-cost harness cable connector to terminate a harness cable in a utilization device, such as a printed circuit board. In order to disconnect a first printed circuit board from a second board or other device, a more conventional connector may be attached to the other end of the harness cable. An example of a more conventional connector is shown in U.S. Pat. No. 3,852,864, which issued on Dec. 10, 1974 and is assigned to the same assignee as the present invention.

In the arrangement of the present invention, the round wires which comprise the flat cable are pressed into a plurality of slots within the cable connector which form a comb-like receptacle for the round wires. The wires are stripped and pre-tinned for insertion into suitable, aligned apertures within a printed circuit board. The harness cable connector aligns the wires in the appropriate configuration to match the printed circuit board apertures for insertion of the wires into the apertures. After insertion, the wires are bent as the harness cable connector is rolled 90° and locked into the printed circuit board, thus providing strain relief for the cable. The wires may then be flow soldered for permanent connection to the printed circuit board as is well known in the art. Through this arrangement, two or more printed circuit boards may be joined together by a flat cable/round wire harness having both ends or one end of the harness permanently connected to the cable connector of this invention; while the other end is connected to a conventional connector if two harness cable connectors are not used.

Accordingly, it is an object of this invention to provide a low-cost harness cable connector.

Another object of the present invention is to provide an improved harness cable connector which may act as an assembly tool for a flat cable/round wire harness and as a strain relief for the harness after assembly.

A further object of the invention is to provide a harness cable connector which eliminates the necessity to handle individual wires when interconnecting printed circuit boards and provides for inserting several wires into a board simultaneously.

Other objects and advantages of the present invention will become apparent to those skilled in the art after careful consideration of the following specification in view of the accompanying drawings, wherein:

BRIEF DESCRIPTION OF THE PREFERRED EMBODIMENT

Figure 1:
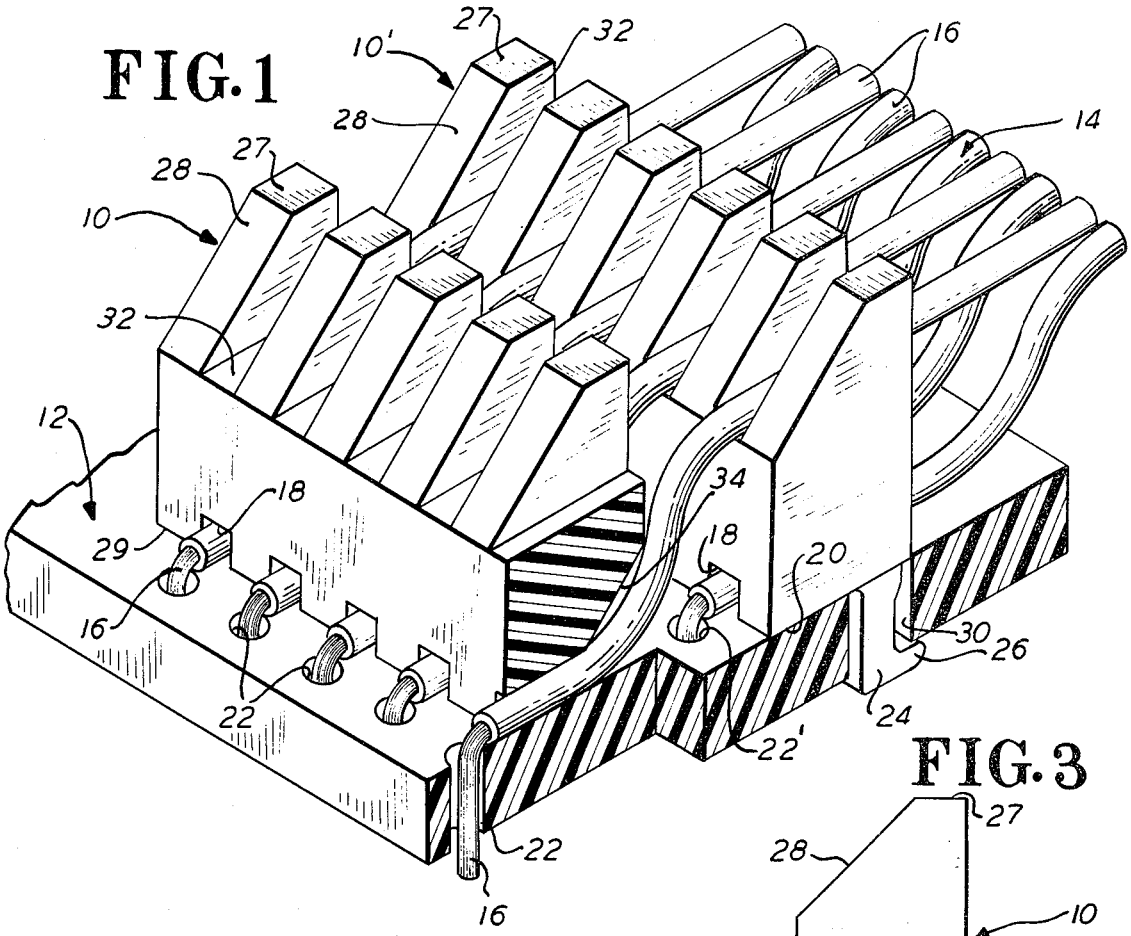
FIG. 1 is a perspective view showing the harness cable connector of the present invention partially broken away and connected in tandem to a flat cable/-round wire harness.

Referring now to the drawings, FIG. 1 shows two harness cable connectors 10 and 10' constructed from insulated housings having a four-sided rectangular cross section arranged in tandem upon a printed circuit board 12. A flat cable/round wire harness 14 includes a plurality of insulated wires 16 which has been stripped and pre-tinned prior to assembly in the harness cable connectors 10 and 10'. The individual insulated wires 16 are assembled by press-fitting the insulation of each individual wire 16 into slots 18 located in a first surface 20 of the harness connector 10. The slots 18 are evenly spaced in a comb-like arrangement across the surface 20 perpendicular to the major longitudinal axis of the harness connector. In the preferred embodiment shown, the spacing of the slots 18 is arranged to coincide with the spacing of alternate wires 16 within the cable. Obviously, this spacing can be made tighter to eliminate the second cable connector 10', if desired, or spread to provide for a tri-connector configuration.

Figure 2:
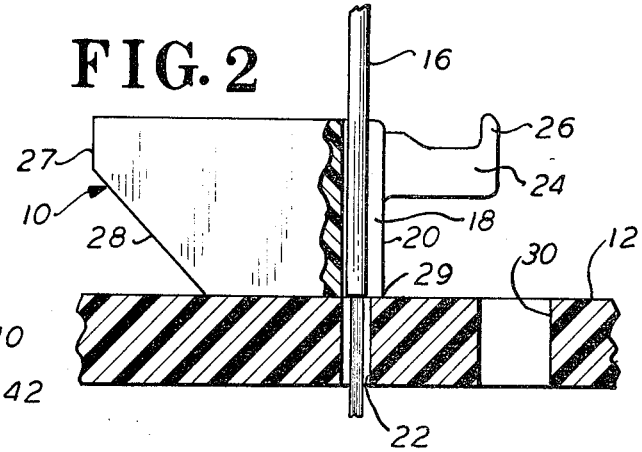
FIG. 2 is a side elevation view showing the harness cable connector of the present invention in a pre-assembled position.

As best seen in FIG. 2, the harness cable connector 10 is used as an assembly tool for retaining the insulated wires 16 in a spaced configuration perpendicular to the printed circuit board 12. The stripped, pre-tinned portion of each wire 16 is inserted into an aperture 22 which is but one of a plurality of spaced apertures arranged across the printed circuit board 12. In the insertion stage of FIG. 2, the first surface 20 is perpendicular to the printed circuit board 12 with locking mechanisms in the form of two latching arms 24 extending outwardly from the upper portions of surface 20 at each end of the harness cable connector 10. The latching arms 24 are each provided with latches 26 which extend from the arms at a right angle thereto and parallel to surface 20. A second surface 27 on top of the harness cable connector 10 opposite the first or bottom surface 20 when viewed in an assembled position (FIG. 3) is provided with a corner edge having a larger chamfer 28 under which a user of the harness cable connector may insert his fingers for gripping the harness cable connector and rolling the connector 90° on a second edge 29 on a clockwise direction to the assembled position shown in FIG. 3.

As the cable harness connector 10 is rolled, the wires 16 are bent 90° by the combined retention of apertures 22 and the rolling action of the connector 10. The latching arms 24 pass into a pair of latch receiving apertures 30 in the printed circuit board 12 which is sized large enough to allow the latch 26 of each latching arm 24 to yield upwardly as the latch arm is inserted therein. Once the latch arm is fully inserted within the aperture 30, the latch 26 is urged by the resiliency of its material to snap out of the aperture 30 and align itself with the surface of the printed circuit board opposite the surface against which the assembled bottom surface 20 of the harness cable connector 10 rests.

As best seen in FIG. 1, two harness cable connector 10 and 10' may be connected to the flat cable/round wire harness 14 by pressing alternate wires from the cable into the first cable connector 10 while pressing the shorter alternate wires from the cable into the second cable connector 10'. The wires in the second cable connector need not be shortened but can be bowed to take up the excess wire length. The wires thus mounted within the second harness cable connector 10' are inserted into a second row of apertures 22' of the printed circuit board 12 and bent 90° by the application of a suitable rolling force to the connector housing 10 through the aid of the chamfer 28. The latch 26 on latching arm 24 yields as it is inserted into the aperture 30 and snaps out once clear of the aperture to lock the harness cable connector 10' into the position shown. The first harness cable connector 10 is then inserted with its plurality of aligned, spaced wires into the apertures 22 and rolled and locked into position as described above.

The top surface 27 of the connector 10 seen in FIG. 1 is provided with a plurality of slots 32 which pass across the full width of that surface to a depth equal to the depth of the chamfer 28. It will be seen that the slots 32 in the second cable connector 10' provide a clearance for the wires 16 connected to the first cable connector 10 as these wires pass over the second harness cable connector 10'. The slots are sized to clear the insulation covering the wires 16. It should be noted from FIG. 1 that the slots 18 which receive the wires 16 by press fit are relieved by an internal chamfer 34 in order to provide freedom for the wires 16 as they are displaced and into the slots 32 of the second connector 10'.

Figure 3:
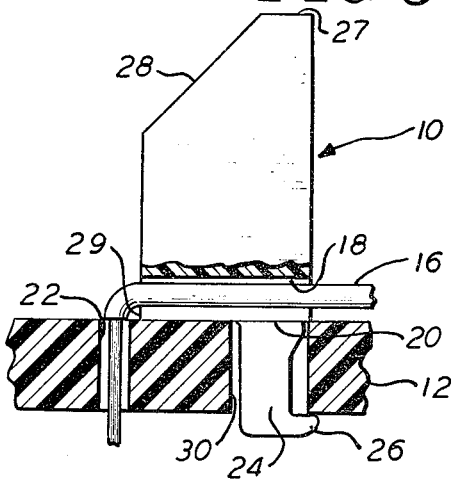
FIG. 3 is a side elevation view showing the harness cable connector in an assembled position.
Figure 4:
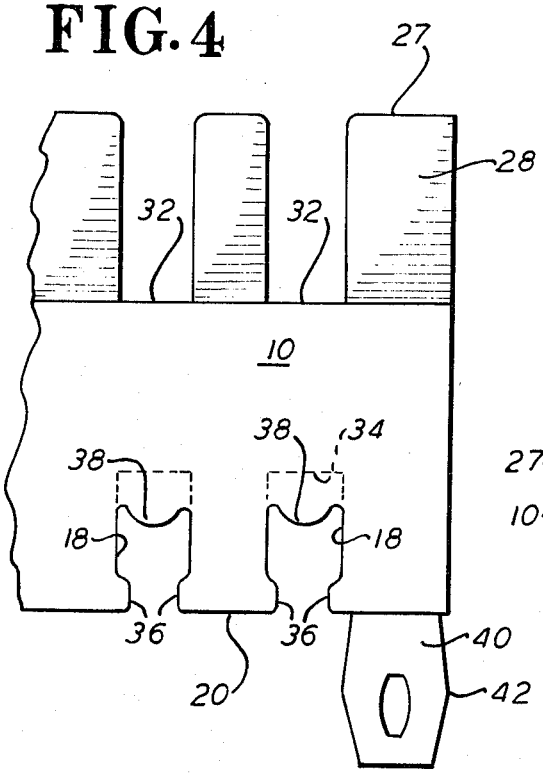
FIG. 4 is an enlarged detail showing a typical slot within the harness cable connector for receipt of a round wire and an alternate locking mechanism.

Referring to FIG. 4, the details of the slots 18 are shown in greater detail wherein each side of the slot 18 is provided with a restricted shoulder portion 36 which extends the full length of the slot. The bottom of slot 18 is relieved along each inner edge to provide a radiused, inwardly directed slot base 38 for receipt of the insulated wires 16. It will be obvious to those skilled in the art that various size slots will be required for various sizes of wiring insulation. However, the shoulders 36, shown in FIG. 4, provide slots 18 which receive a broader range of insulation sizes. Further, the shoulders 36 may be interrupted to increase the tolerance range of wire size received A second locking mechanism suitable for use in the present invention is shown in FIG. 4. Here, the latch arms 24 and latches 26 are replaced with a pair of locking arms 40 placed in the same position as the latch arms 24. Each locking arm tapers outwardly from the bottom surface 20 to a widest point 42 where the taper is reversed to the end of the arm. In the side view, not shown, the arm 40 has a uniform thickness. The widest shoulder thus formed at point 42 on the arm 40 is located below the printed circuit board surface when assembled as shown in FIG. 3 to provide a latching against unauthorized removal.

In the present invention the method of assembly includes the steps of stripping and pre-tinning of the wires 16. The wires are then pressed into the connector 10 which aligns and spaces the wires 16 as an assembly tool. The wires are then inserted into the apertures 22 and the harness cable connector is rolled 90° on its edge 29 where locking arms are locked into the apertures 30 of the printed circuit board 12. In this configuration the harness cable connector 10 acts as a strain relief for the wires which make up the flat cable/round wire harness 14. The wires are then connected to the printed circuit board, as by flow soldering, which is well known in the art.

The present invention provides a low-cost means of connecting a flat cable/round wire harness to a printed circuit board. Obviously, this arrangement may be used with other cable configurations. While the present invention has been described as the utilization of a conventional connector at the second end of the flat cable/round wire harness 14, it will also be obvious to those skilled in the art that other arrangements and combinations are possible.

The embodiments of the invention in which an exclusive property or privilege is claimed are defined as follows:

1. A cable connector for connecting a plurality of conductive elements to a planar substrate and to conductive paths on the surface thereof, comprising:

a housing having first and second housing surfaces joined at a common edge, said first housing surface having a plurality of equally spaced slots across its full width for individually mounting said plurality of conductive elements therein;

said planar substrate having a plurality of equally spaced apertures which receive said conductive elements mounted in said slots as said second housing surface is positioned against said planar surface;

means for rolling said housing about said common edge to remove said second housing surface from its position against said planar surface and instead position said first housing surface against said planar surface for bending said plurality of conductive elements received by said planar surface apertures; and means for locking said housing in said position with said first housing surface against said planar surface.

2. A cable connector for connecting a plurality of conductive elements to a planar substrate as claimed in claim 1, wherein said first and second housing surfaces are perpendicularly arranged with each other and said conductive elements are bent 90° as said housing is rolled on said common edge

3. A cable connector for connecting a plurality of conductive elements to a planar substrate as claimed in claim 1, wherein said conductive elements are round, insulated, conductive wires woven into a flat cable and said equally spaced slots in said first housing surface of said housing are each provided with shoulder means arranged in said first housing surface at said slot opening therein to narrow said slot at said surface to provide for a press fit reception of differing insulation diameters upon said round conductive wires.

4. A cable connector as claimed in claim 1, wherein said means for locking includes a locking arm perpendicularly extending from said first housing surface of said housing and a latch tab perpendicular to said locking arm and parallel to said first housing surface, said planar substrate having at least one locking aperture said latch tab passing through said locking aperture and engaging said planar substrate in a parallel relationship thereto when said housing is rolled and locked to said substrate.

5. A cable connector as claimed in claim 1, wherein said means for locking includes a locking arm perpendicularly extending from said first surface of said housing having at least two diverging surfaces which widen said arm to a widest shoulder, said planar substrate having at least one locking aperture said widest shoulder passing through said locking aperture and engaging said planar substrate on an opposite side from said first housing surface when said housing is rolled and locked to said substrate with said first housing surface parallel thereto.

6. A cable connector for connecting a plurality of conductive elements to a planar substrate as claimed in claim 1, wherein said conductive elements are round conductive wires joined into a flat insulated cable and said planar substrate is a printed circuit board.

7. A cable connector as claimed in claim 6, wherein said plurality of round conductive wires joined into a flat insulated cable is received by two housings each receiving alternate conductive wires within said flat insulated cable.

8. A cable connector for connecting a plurality of conductive elements to a planar substrate as claimed in claim 1, wherein said conductive elements are round, insulated, conductive wires and said equally spaced slots in said first housing surface of said housing each has an opening width which receives each of said insulated conductive wires under a press fit.

9. A cable connector as claimed in claim 8, wherein said means for rolling said housing include a third housing surface opposite and parallel to said first housing surface having a chamfered edge surface arranged on an edge of said housing adjacent said planar surface when said housing is arranged with said first housing surface perpendicular to said planar surface, said chamfered surface facilitating the rolling of said housing to position said first housing surface parallel to said planar substrate.

10. A cable connector as claimed in claim 9, wherein said third housing surface of said housing is provided with a plurality of slots therein, and said plurality of slots in said third housing surface each has an opening width which receives each of said insulated conductive wires under a clearance fit.

11. A harness cable connector mounting a plurality of insulated wires which make up a flat cable harness for connecting the ends of said wires to a circuit board, comprising:

an insulated housing having a rectangular cross section with perpendicular first and second housing surfaces joined at an edge, said first housing surface having a plurality of equally spaced slots therein for mounting said plurality of insulated wires under a press fit;

said circuit board having a plurality of equally spaced wire receiving apertures which receive said wires with said insulation removed from the ends thereof when said wires mounted in said slots are aligned with said apertures and when said first housing surface is perpendicular to said circuit board;

said circuit board having at least one locking aperture spaced from said first mentioned wire receiving apertures;

means for locking said insulated housing into said locking aperture as said housing is rolled on said edge joining said first and second housing surfaces for locking said housing to said circuit board with said first housing surface parallel to said circuit board and said plurality of equally spaced slots closed thereby.

* * * * *